United States Patent [19]

Hervert

[11] 3,982,100

[45] Sept. 21, 1976

[54] MONOLITHIC HONEYCOMB FORM ELECTRIC HEATING DEVICE

[75] Inventor: George L. Hervert, Woodstock, Ill.

[73] Assignee: Universal Oil Products Company, Des Plaines, Ill.

[22] Filed: Oct. 8, 1974

[21] Appl. No.: 513,028

[52] U.S. Cl. ..... 219/553; 219/374; 219/543; 252/502; 338/223; 338/283; 427/249

[51] Int. Cl.[2] ..... H05B 3/10

[58] Field of Search ..... 219/300, 345, 369, 370, 219/374, 381, 543, 553; 13/22, 25, 31; 357/10; 117/46 BC, 46 CC, 212, 215, 221, 224, 226; 161/182, 68; 118/49.5; 156/296; 338/223, 283, 292, 294, 308, 309; 252/421, 477, 502, 512

[56] References Cited

UNITED STATES PATENTS

| | | | |
|---|---|---|---|
| 2,767,289 | 10/1956 | Robinson | 338/223 |
| 3,032,635 | 5/1962 | Kraft | 338/286 X |
| 3,163,841 | 12/1964 | Willett | 338/292 |
| 3,213,177 | 10/1965 | Diefendorf | 117/226 X |
| 3,345,448 | 10/1967 | Malkin | 13/25 |
| 3,651,386 | 3/1972 | Youtsey et al. | 357/10 |
| 3,700,857 | 10/1972 | Brandes et al. | 219/543 |
| 3,825,460 | 7/1974 | Yoshikawa et al. | 156/296 |

FOREIGN PATENTS OR APPLICATIONS

| | | | |
|---|---|---|---|
| 512,667 | 10/1920 | France | 219/374 |
| 932,558 | 7/1963 | United Kingdom | 219/300 |
| 299,036 | 4/1971 | U.S.S.R. | 219/381 |

*Primary Examiner*—Volodymyr Y. Mayewsky
*Attorney, Agent, or Firm*—James R. Hoatson, Jr.; Philip T. Liggett; William H. Page, II

[57] ABSTRACT

A monolithic electrical resistance heater element is produced from mixing particles of a conductive carbonaceous pyropolymer that have been deposited on a refractory metal oxide with a heat unifiable ceramic, such as alumina, cordierite, spodumene, etc., and then forming a resulting rigid "honeycomb type" of semiconductive ceramic substrate. The carbonaceous pyropolymer particles are preferably formed from heating an organic pyrolyzable substance in contact with alumina particles, or other metal oxide particulates, at a temperature above about 400° C.

2 Claims, 5 Drawing Figures

Figure 1
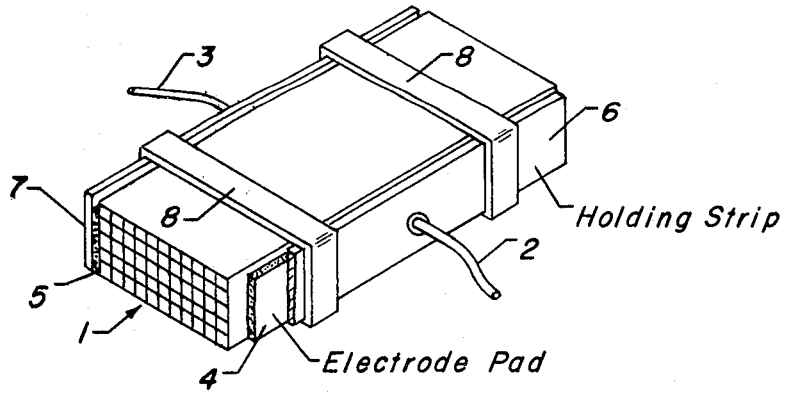
Figure 2
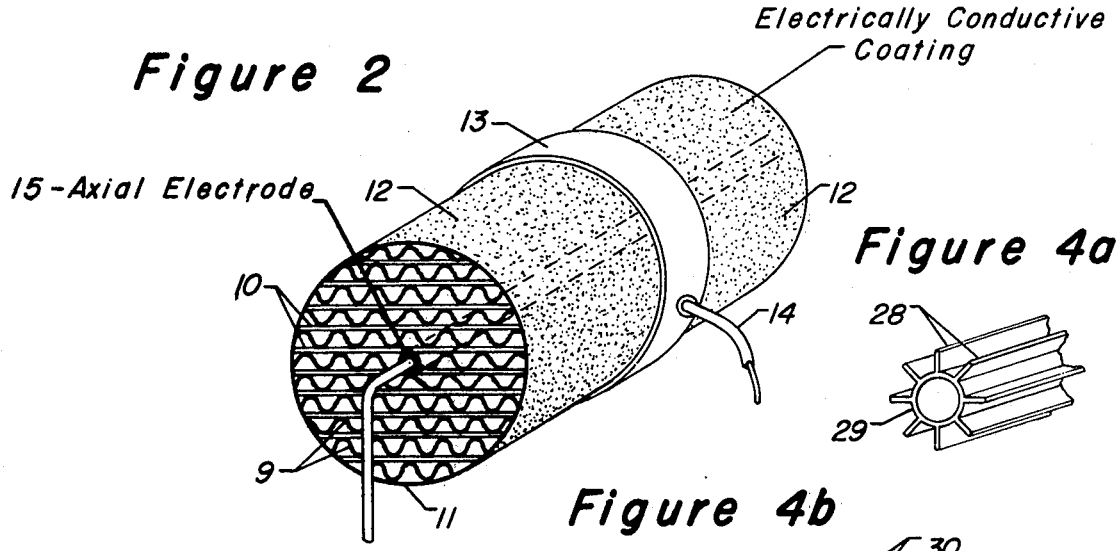
Figure 4a
Figure 4b
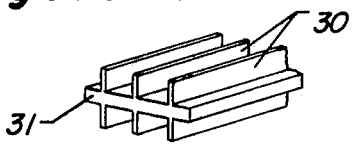
Figure 3
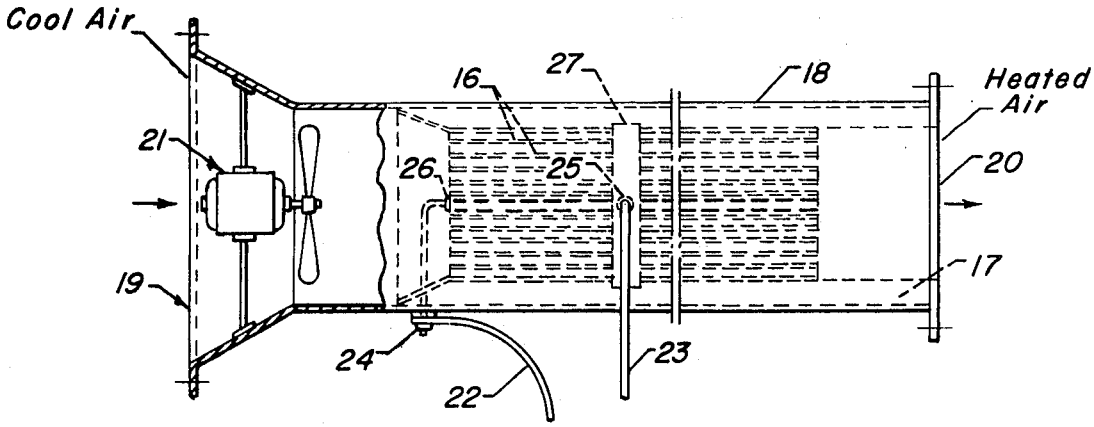

MONOLITHIC HONEYCOMB FORM ELECTRIC HEATING DEVICE

This invention relates to novel forms of honeycomb or other extended surface area electrical resistance elements and heater devices, and to the method for making rigid, monolithic types of semiconductive elements from the mixing of a conductive carbonaceous pyropolymer with a non-conductive ceramic substrate.

It is realized that there are many forms of resistance elements and many types of electrical resistance devices which have been developed and made for use in homes and industry; however, none of the known heater devices have embodied the special carbonaceous pyropolymer of the present invention. Nor are there any known resistance elements which are electrically conductive ceramic honeycomb form members from the combination of a special carbonaceous pyropolymer and a heat setting ceramic type of material. There are, of course, known types of small resistors which embody the depositions of carbon or graphite particles, carbon inks, etc., as part of the "thick film" technology. Also, there are certain types of resistors which comprise pressed powder mixes which, in turn, are made from metal, carbon or other semiconductors materials.

The electrical conductivity of a material necessarily falls into one of three categories: conductors, semiconductors, or insulators. Conductors are those materials generally recognized to have a conductivity greater than about $10^2$ inverse ohm-centimeters, while insulators have a conductivity no greater than about $10^{-10}$ inverse ohm-centimeters. Materials with a conductivity between these limits are considered to be semiconducting materials. In this instance, the invention is directed to the use of semiconductor material prepared in accordance with the teachings of U.S. Pat. No. 3,651,386.

Specifically, it may be considered to be a principal object of this invention to provide novel electric resistance elements for resistance heater devices which will be produced from mixing a semiconducting carbonaceous pyropolymer with a ceramic substrate that can be heat rigidified. In particular, it is preferred to cast or extrude the desired high surface area members in a manner to have a multiplicity of ribs or fins or, more especially, to provide a honeycomb type of element where a multiplicity of open channels therethrough will provide a large ratio of surface area per unit volume. The honeycomb form of electric heating element is of particular advantage in that it provides a high surface area heat exchange surface that, in turn, can effect a rapid, efficient heat transfer to a gaseous or liquid media that may be passed through the channels of the element.

In a broad aspect, the present invention provides a resistance heating element, which comprises, an extended surface area conductive rigid ceramic-pyropolymer member that results from the admixture of conductive subdivided refractory particles having a coating of a carbonaceous pyropolymer thereon with a primarily crystalline ceramic type material which can be thermally rigidified, and where said coating on the refractory particles has a conductivity of from about $10^{-8}$ to about $10^2$ inverse ohm-centimeters resulting from heating an organic pyrolyzable substance in a primarily non-oxidizing atmosphere in contact with the particles at a temperature above about 400°C.

In another embodiment, the invention provides a resistance heating device, which comprises in combination: (a) a rigid substrate having a plurality of passageways therethrough to form a honeycomb type structure resulting from a mixture of thermally unifiable primarily crystalline material with refractory subdivided particles that have a semiconducting coating with a conductivity of from about $10^{-8}$ to about $10^2$ inverse ohm-centimeters in turn provided by a layer of a carbonaceous pyropolymer formed from heating an organic pyrolyzable substance in a primarily non-oxidizing atmosphere and in contact with the particle surfaces at a temperature above about 400° C., and (b) spaced electrodes to opposing portions of said honeycomb substrate, whereby the resulting semiconductive substrate positioned between such electrodes can provide electrical resistance heating from an electrical energy supply to the electrodes.

As will hereinafter be set forth more fully, there may be two methods of applying the carbonaceous pyropolymer coating to the refractory particles. In one instance, the particles may be dipped into the organic pyrolyzable substance and then dried and pyrolyzed in the presence of nitrogen or other generally non-oxidizing atmosphere. In another instance, the coating can be applied in a vapor phase operation where the organic pyrolyzable substance is entrained in a substantially non-oxidizing atmosphere at high temperature conditions so as to effect the continuous buildup of the resulting carbonaceous pyropolymer.

It is also within the scope of the present invention to provide varying sizes and shapes for the monolithic resistance element. Ribbed or finned tubes and rods will be generally of an elongated configuration with a multiplicity of ribs to result in a high surface area element. The various high surface area honeycomb type elements may be in a generally square or rectangular form with the electrodes connecting to two opposing side portions of the element whereby the resistance of the element will, in turn, provide a heating device when current is supplied to the electrodes. Alternatively, in another embodiment, the honeycomb form element may have a generally cylindrical shape with longitudinal passageways extending parallel to the axis of the cylinder such that there may be air or other fluid flow passing through the multiplicity of parallel passageways. The electrodes to the coated semiconducting element may be provided from opposing side portions of the cylinder; however, in order to have uniform equal distances for current travel, it may be considered advantageous to have one electrode extending longitudinally and axially through the center of the element and an opposing electrode connecting to a band which encompasses the exterior of the cylindrical form element, such that current flow is radially through the element.

To insure good current distribution from the opposing electrodes and opposing surfaces, there can be a flash coating of stainless steel, or of silver or gold, on such surfaces. Alternatively, there may be used stainless steel felt pads, fine mesh pads, etc., to effect the desired current distribution.

With regard to physical characteristics, the semiconducting carbonaceous pyropolymer being provided for admixture with the ceramic material in accordance with the present invention will have a matte black color, with a surface area dependent generally upon the nature of the metal oxide particulate material. Structurally, the material is a precursor to graphite. The thermal conductivity of a coated element will also be essentially that of the oxide substrate. The electrical conductivity of the pyropolymer at room temperature is about $10^{-8}$ to about $10^{2}$ inverse ohm-centimeters. However, the electrical resistivity of the pyropolymer can be varied in a controlled manner over more than ten orders of magnitude, i.e. ranging from insulating ($10^{10}$ ohm-centimeters) to the value of graphite ($10^{-1}$ ohm-centimeters) at the low end of the range. The greater the temperature and the greater the time period utilized during the vapor phase deposit of the pyropolymer layer onto the subdivided oxide, the higher the resulting conductivity, or the lower the resistivity.

In connection with the present invention, the refractory oxide substrate for the carbonaceous pyropolymer deposit is preferably on material with a high surface area such as gamma-alumina. Thus, the base material can be characterized as one having a surface area of from 1 to about 500 square meters per gram. However, other refractory metal oxides such as silica, magnesia, boria, thoria, etc., or combinations and mixtures thereof may well be utilized.

Examples of organic substances which may be pyrolyzed to form the pyropolymer on the surface of the refractory oxide support will include aliphatic hydrocarbons, cycloaliphatic hydrocarbons, aromatic hydrocarbons, aliphatic halogen derivatives, aliphatic oxygen derivatives, aliphatic sulfur derivatives, aliphatic nitrogen derivatives, heterocyclic compounds, organometallic compounds, etc. Some specific examples of these organic compounds which may be pyrolyzed will include ethane, propane, butane, pentane, ethylene, propylene, 1-butene, 2-butene, 1-pentene, 2-pentene, 1,3-butadiene, isoprene, cyclopentane, cyclohexane, methylcyclopentane, benzene, toluene, the isomeric xylenes, naphthalene, anthracene, chloromethane, bromomethane, chloroethane, bromoethane, chloropropane, bromopropane, iodopropane, chlorobutane, bromobutane, iodobutane, 1,2-dichloroethane, 1,2-dichloropropane, 1,2-dichlorobutane, ethyl alcohol, n-propyl alcohol, isopropyl alcohol, n-butyl alcohol, sec-butyl alcohol, t-butyl alcohol, glycol, glycerol, ethyl ether, isopropyl ether, butyl ether, ethyl mercaptan, n-propyl mercaptan, butyl mercaptan, methyl sulfide, ethyl sulfide, ethyl methyl sulfide, methyl propyl sulfide, dimethyl amine, diethyl amine, ethyl methyl amine, acetamide, propionamide, nitroethane, 1-nitropropane, 1-nitrobutane, acetonitrile, propionitrile, formic acid, acetic acid, oxalic acid, acrylic acid, formaldehyde, acid aldehyde, propionaldehyde, acetone, methyl ethyl ketone, methyl propyl ketone, ethyl propyl ketone, methyl formate, ethyl formate, ethyl acetate, benzyl chloride, phenol, o-cresol, benzyl alcohol, hydroquinone, resorcinol, catechol, anisole, phenetole, benzaldehyde, acetophenone, benzophenone, benzoquinone, benzoic acid, phenyl acetate acid, hydrocinnamic acid, furan, furfural, pyran, coumarin, indole, carbohydrate derivatives such as sugars, including dextrose, fructose, sucrose, starches, etc. It is to be understood that the aforementioned compounds are only representative of the class of compounds which may undergo pyropolymerization and that the present invention is not necessarily limited thereto.

As hereinbefore set forth the aforementioned organic compounds are dip coated on the substrate or are admixed with a carrier gas such as nitrogen or hydrogen, heated and thereafter passed over the refractory oxide substrate. The deposition of the pyropolymer on the surface of the base is effected at relatively high temperatures ranging from about 400° to about 1100° C. and preferably in a range of from about 600° to about 950° C. Also, as heretofore noted, it is possible to govern the electrical properties of the semiconducting pyropolymeric coating by regulating the temperature and residence time during which the refractory oxide base is subjected to the treatment with the organic pyrolyzable substance. The thus prepared semiconducting pyropolymeric inorganic refractory oxide material when recovered will possess a resistivity in the range of from about $10^{-2}$ to about $10^{8}$ ohm centimeters.

As for the refractory ceramic material to be admixed with the pyropolymer on the subdivided particles of metal oxide, there is provided a thermal setting inert crystalline ceramic material. For example, the ceramic material may be of sillimanite, magnesium silicates, silicates, zircon, petalite, spodumene, cordierite, aluminosilicates, mullite, and of mixtures of various of the aforesaid materials, such as zirconmullite, etc. Certain of these types of materials have been or are produced commercially in the making of corrugated or honeycomb shaped ceramics by such companies as E. I. du-Pont de Nemours and Company; Corning Glass Works; and the American Lava Corporation, a subsidiary of 3M Company. The honeycomb shapes, or other high surface area configurations, can be cast, extruded, or formed from corrugated sheets, etc., and it is not intended to limit the invention to any one procedure.

While the ceramic material will typically comprise an alumino-silicate or an alumina-magnesia-silicate, it is to be understood that alpha-alumina, thoria, beryllia, titania, and the like, as well as certain clays and combinations of any of the foregoing, may well be used. The binders used in preparing a green material or structure can be any of numerous materials known to the art. However, where of an organic nature, it is desirable to use materials that will readily volatilize on firing and heating without producing large volumes of gases that might react with the metal oxide coated with the pyropolymer or with the particular ceramic employed. Suitable organic binders may be vegetable gums, natural resins, polysaccharides, as well as synthetically made materials such as thermosetting polymers, resins, and the like. In other words, binders may comprise starch, gum acacia, rosin, methyl cellulose, cellulose acetate, polystyrene, polyvinyl alcohol, polyvinyl acetate, and the like.

Actually, various ceramics and various methods of making honeycomb structures have been set forth in the literature and presently issued patents, i.e. U.S. Pat. Nos. 3,444,925, 3,505,030, and in the patent art mentioned in these patents.

In preparing the composite ceramic-carbonaceous pyropolymer mixture for, in turn, making the honeycomb or other high surface area configuration, there can be varying percentage composites. For example, the coated, conductive metal oxide particulates may comprise from about 20% to 90% of the resulting element and the non-conductive ceramic from about 10% to 80% of the heater element. The amount of pyropolymer coated metal oxide particles will vary in accordance with the desired conductivity, or resistivity of the finished heater element. It should, of course, be realized that the length of an element, or distance between electrodes, will also effect the total resistance of an element in any particular electrical resistance heating device.

The specific improved types and forms of electrical resistance elements and heaters of the present invention may be better understood as to design and arrangement, as well as with regard to further advantages, by reference to the accompanying drawings and the following descriptions thereof.

FIG. 1 of the drawing is a diagrammatic view indicating a heating device utilizing a rectangular form of semiconductive ceramic-carbonaceous pyropolymer honeycomb element with electrodes connecting to the two opposing side portions of the element.

FIG. 2 of the drawing indicates diagrammatically a cylindrical form of semiconductive honeycomb element made in accordance with the present invention with an axial electrode and a circumferential electrode, with the latter in part utilizing a conductive metallic coating to encompass the entire external periphery of the cylindrical element of the device.

FIG. 3 of the drawing is an electrical heating apparatus having fan means to introduce an air stream through an internal honeycomb type of ceramic-carbonaceous pyropolymer element which is provided with current supplying electrodes in a manner similar to the arrangement of FIG. 2.

FIGS. 4*a* and 4*b* of the drawing show diagrammatically alternative forms of high surface area elements which may be cast, extruded or otherwise shaped as rigid, monolithic ceramic-carbonaceous pyropolymer elements suitable for electrical resistance heaters.

Referring now particularly to FIG. 1 of the drawing, there is shown a rectangular form of honeycomb element 1, which in accordance with the teachings of the present invention, will have been provided from extruding or otherwise forming a semiconductive mixture of a carbonaceous pyropolymer on metal oxide particles and a ceramic material. The present element indicates small substantially square open passageways through the length of the element; however, as heretofore noted, various types of honeycombs may be formed which in turn may have varying sizes and configurations for the longitudinal open passageways formed in the substrate. The finished element will be generally black, with the shade depending upon the percentages of pyropolymer material and ceramic material, and although semiconductive, the resistance will be greater than the pyropolymer coated metal oxide material used in the composite such that transmission of electric current through the element will cause electrical resistance heating and resulting heat radiation from all of the surfaces of the element. Although not shown in the drawing, air or liquid streams can be caused to flow through the passageways of the element in order to provide for heat transfer into the particular fluid stream.

Various methods may be provided for attaching electrodes to the side portions of the element 1; however, in the present embodiment, there is indicated the use of electrical current conductive wires 2 and 3 carrying current to distributing electrode pads 4 and 5. Again, various types of electrode pad means may be utilized, as for example stainless steel gauze, or stainless steel wool. Preferably, a metal will be utilized which is not readily oxidizable nor corroded and which might cause an undesirable film or oxide material to encompass the electrode area. There is also indicated in the present drawing the utilization of holding bar means 6 and 7 along with tie band means 8 to insure the holding of the electrode pads 4 and 5 tightly against the coated side surfaces of the element 1.

Still other types of electrode means may be used, as for example, the utilization of precious metal monolayers from a paste or wash operation, or flash coatings of stainless steel, etc., to the particular current distributing side portions of the element such that the current supply wires may then be brought into contact with the metallic coatings through relatively small pad means or other suitable current distributing terminal means.

In FIG. 2 of the drawing there is indicated a cylindrical form of rigid ceramic-carbonaceous pyropolymer where internal wave-form members 9 and substantially flat members 10 will provide a multiplicity of longitudinal passageways through the element. There is also provided an encompassing ceramic wall portion 11 to form the cylindrically shaped substrate. In accordance with the present invention, the element is a rigid, thermally set mixture of ceramic and semiconductive carbonaceous pyropolymer coated metal oxide particles. The encompassing surface of the present embodiment is, in turn, provided with an electrically conductive coating 12 which, as heretofore noted, may be a monolayer of a precious metal such as silver or gold, or may comprise a flash coating of stainless steel, or the like. It is the purpose of the metallic coating 12 to provide a continuous, highly electrically conductive surface around the entire cylindrical form element and be able to carry current from conductive band means 13 and wire 14 to such outer surface. The opposing electrode, with respect to the peripheral surface, is provided by an axial electrode at 15 which will extend longitudinally through the entire length of the substrate. Such electrode may comprise a stainless steel bar, stainless steel wool or rolled gauze, or of other suitable electrode metal. Preferably, the axial electrode will be in a form that will provide good contact with the surfaces extending to the core of the substrate such that there will be good transfer of current from the electrode into the surfaces of the semiconductive substrate at the core portion thereof.

In order to illustrate a somewhat more complete form of electrical heating apparatus, there is indicated in FIG. 3 of the drawing the utilization of a ceramic-carbonaceous pyropolymer form of honeycomb substrate at 16, which embodies a mixture suitable to provide electrical resistance heating. The heater element is, in turn, encompassed by insulating means 17 and an exterior housing 18 to provide a tubular form of heating apparatus with a cool air intake means 19 at one end and an outlet portion 20 for discharging air. There is also indicated the utilization of a motor-operated fan means at 21 to force cool air through the passageways of the honeycomb 16 whereby the latter can give up heat to the air stream being discharged by way of outlet 20. The electrical current supply for the device will be introduced by way of wires 22 and 23 which connect at the respective terminals 24 and 25. Terminal 24 is indicated as connecting to an axial electrode 26 while terminal 25 will connect to a current distributing band 27 and to an electrically conductive surface over the entire periphery of the element 16. Thus, as with the embodiment of FIG. 2, there will be radial current transmission through the cylindrical form of element and resistance heating to all of the surfaces thereof, whereby there will be heat transfer to the air stream passing through the multiplicity of passageways of the element.

The surface temperature of a particular element will, of course, depend upon the intensity of the electric currents being supplied to the electrodes. Preferably, the surface temperature will be maintained well below the oxidizing temperature of the carbonaceous pyropolymer in the ceramic mixture and thus preferably below about 600° to 700° F. For example, element surface temperatures might well be in the 410° to 450° F. range and provide air flow temperatures from the element in the 400° to 425° F. range. In any particular heating device, the size of the element and the current supply to the electrodes therefore will be adjusted to provide a preferred range of temperature output to suit the particular heating conditions. Actually, large heaters utilizing house current could serve as room heaters, while small heaters operating from a car battery might well serve as an air heater for an internal combustion engine in order to improve an engine start-up for cold weather.

Enumerable sizes and shapes of substrates may be employed forming a particular type of heater device and enumerable sizes and configurations may be obtained in connection with honeycomb forms of ceramics to provide a particular substrate. Heating elements and/or heating devices may be designed to accommodate various liquid flows and not be limited to the heating of an air stream which will be passed therethrough. Actually, it is believed that the carbonaceous pyropolymer provided in combination with the ceramic substrate will be inert to most all acid and base materials.

The present types of heater devices will, of course, operate in a low temperature range as compared with usual resistance wire heating elements which normally operate in the red heat range such that there is far less danger to persons, or to materials, for possible burnings. From another aspect, there is an inherent safety feature in the use of the present monolithic heating elements in that when they are overloaded in an oxygen-containing atmosphere there will be a burning out of a portion of a layer at a much lower temperature than would occur with a resistance wire heating element so that it is, in effect, operating like a fuse, providing a burn-out and breakage without damage to wiring or other parts of an apparatus.

Although not shown in any of the drawings, it may be of advantage to provide a suitable protective coating over the carbonaceous pyropolymer layer to preclude errosion and undesired further oxidation or corrosion aspects. For example, a layer of a suitable non-conductive, heat stable "plastic" material may be used to advantage to provide the desired protective coating, with such material being an epoxy resin, fluoroplastics, phenol-formaldehyde, polyesters, polyaryl sulfone, polysulfone, polyphenylene sulfides, polyimides, polysilicone, or the like, or multilayer combinations of any of the foregoing.

I CLAIM AS MY INVENTION:

1. A resistance heating device which comprises in combination a rigid monolithic resistance heating element with an extended surface area comprising a honeycomb type structure with a plurality of passageways therethrough and resulting from an admixture of semiconductive refractory inorganic oxide particles with a thermally unifiable ceramic material, and said semiconductive particles have a semiconducting coating thereon with a conductivity of from about $10^{-8}$ to about $10^{2}$ inverse ohm-centimeters in turn provided by a carbonaceous pyropolymer formed from heating an organic pyrolyzable substance in a non-oxidizing atmosphere and in contact with particle surfaces at a temperature above about 400° C., and spaced electrodes are provided to opposing portions of said extended surface area element, whereby the resulting semiconductive element positioned between such electrodes will provide electric resistance heating from an electric energy supply to the electrodes.

2. The heating element of claim 1 further characterized in that said refractory oxide particles comprise subdivided alumina.

* * * * *